US009303510B2

(12) United States Patent
Dumont et al.

(10) Patent No.: US 9,303,510 B2
(45) Date of Patent: Apr. 5, 2016

(54) DOWNHOLE FLUID ANALYSIS METHODS

(71) Applicant: Schlumberger Technology Corporation, Sugar Land, TX (US)

(72) Inventors: Hadrien Dumont, Houston, TX (US); Michael O'Keefe, Loddefjord (NO); Beatriz E. Barbosa, Houston, TX (US); Oliver C. Mullins, Ridgefield, CT (US); Youxiang Zuo, Sugar Land, TX (US); Vinay Mishra, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 471 days.

(21) Appl. No.: 13/829,097

(22) Filed: Mar. 14, 2013

(65) Prior Publication Data

US 2014/0238667 A1 Aug. 28, 2014

Related U.S. Application Data

(60) Provisional application No. 61/770,097, filed on Feb. 27, 2013.

(51) Int. Cl.
*E21B 49/08* (2006.01)

(52) U.S. Cl.
CPC ..... *E21B 49/082* (2013.01); *E21B 2049/085* (2013.01)

(58) Field of Classification Search
CPC ..... E21B 49/082; E21B 49/081; E21B 49/10; E21B 2049/085
See application file for complete search history.

(56) References Cited

U.S. PATENT DOCUMENTS

| | | | | | |
|---|---|---|---|---|---|
| 4,860,580 | A * | 8/1989 | DuRocher | 73/152.26 |
| 5,233,866 | A * | 8/1993 | Desbrandes | 73/152.05 |
| 5,329,811 | A * | 7/1994 | Schultz et al. | 73/152.02 |
| 5,934,374 | A * | 8/1999 | Hrametz et al. | 166/264 |
| 6,216,782 | B1 * | 4/2001 | Skinner | 166/250.01 |
| 6,467,544 | B1 * | 10/2002 | Brown et al. | 166/264 |

(Continued)

FOREIGN PATENT DOCUMENTS

| | | | |
|---|---|---|---|
| EP | 1205630 | A2 | 5/2002 |
| WO | 9411611 | A1 | 5/1994 |
| WO | 2010048054 | A2 | 4/2010 |

OTHER PUBLICATIONS

Alkafeef, Saad F. and Al-Medhadi, Fahad; and Al-Shammari, Ali D. "A Simplified Method to Predict and Prevent Asphaltene Deposition in Oilwell Tubings: Field Case," SPE Production & Facilities, SPE84609, May 2005, pp. 126-132.

(Continued)

*Primary Examiner* — Jennifer H Gay
(74) *Attorney, Agent, or Firm* — Kenneth L. Kincaid

(57) ABSTRACT

Fluid analysis measurements may be performed during withdrawal of a downhole tool to the surface. Fluid may be collected within a fluid analysis system of the downhole tool and the collected fluid may be exposed to the wellbore pressure during withdrawal of the downhole tool. Measurements for the collected fluid, such as optical density, the gas oil ratio, fluid density, fluid viscosity, fluorescence, temperature, and pressure, among other, may be recorded continuously or at intervals as the downhole tool is brought to the surface. The measurements may be employed to determine properties of the collected fluid, such as the saturation pressure and the asphaltene onset pressure.

14 Claims, 6 Drawing Sheets

(56) References Cited

U.S. PATENT DOCUMENTS

| | | | | |
|---|---|---|---|---|
| 6,501,072 | B2 | 12/2002 | Mullins et al. | |
| RE38,129 | E * | 6/2003 | Kleinberg | 73/152.18 |
| 6,688,390 | B2 | 2/2004 | Bolze et al. | |
| 7,002,142 | B2 | 2/2006 | Mullins et al. | |
| 7,197,923 | B1 * | 4/2007 | Wright et al. | 73/152.23 |
| 7,677,307 | B2 | 3/2010 | Vasques et al. | |
| 8,082,780 | B2 | 12/2011 | Vannuffelen et al. | |
| 8,136,395 | B2 * | 3/2012 | Pop et al. | 73/152.51 |
| 8,156,800 | B2 | 4/2012 | Terabayashi et al. | |
| 8,335,650 | B2 | 12/2012 | Hsu et al. | |
| 8,434,356 | B2 * | 5/2013 | Hsu et al. | 73/152.18 |
| 2002/0084072 | A1 * | 7/2002 | Bolze et al. | 166/264 |
| 2002/0194907 | A1 * | 12/2002 | Bostrom et al. | 73/152.58 |
| 2003/0173115 | A1 * | 9/2003 | Krueger et al. | 175/59 |
| 2004/0144533 | A1 * | 7/2004 | Zazovsky | 166/250.02 |
| 2004/0216521 | A1 * | 11/2004 | Shammai et al. | 73/152.55 |
| 2004/0216874 | A1 * | 11/2004 | Grant et al. | 166/264 |
| 2005/0099618 | A1 * | 5/2005 | DiFoggio et al. | 356/70 |
| 2005/0247119 | A1 * | 11/2005 | DiFoggio et al. | 73/152.47 |
| 2006/0076144 | A1 * | 4/2006 | Shammai et al. | 166/370 |
| 2006/0137479 | A1 * | 6/2006 | Gilbert | 73/864.16 |
| 2006/0243033 | A1 * | 11/2006 | Freemark et al. | 73/64.45 |
| 2007/0137896 | A1 * | 6/2007 | Villareal et al. | 175/59 |
| 2008/0087470 | A1 * | 4/2008 | Villareal et al. | 175/50 |
| 2008/0156088 | A1 * | 7/2008 | Hsu et al. | 73/152.23 |
| 2009/0078036 | A1 * | 3/2009 | Terabayashi et al. | 73/152.55 |
| 2009/0078860 | A1 * | 3/2009 | Kischkat et al. | 250/269.1 |
| 2010/0154529 | A1 * | 6/2010 | Terabayashi et al. | 73/152.27 |
| 2011/0093200 | A1 * | 4/2011 | Hsu et al. | 702/8 |
| 2011/0218736 | A1 | 9/2011 | Pelletier | |
| 2012/0018147 | A1 * | 1/2012 | Niconoff | 166/250.01 |
| 2012/0158337 | A1 * | 6/2012 | Singh et al. | 702/84 |
| 2013/0019671 | A1 * | 1/2013 | Stibbe et al. | 73/152.24 |
| 2013/0019672 | A1 * | 1/2013 | Hemsing | 73/152.51 |
| 2013/0112406 | A1 * | 5/2013 | Zuo et al. | 166/250.08 |
| 2014/0212986 | A1 * | 7/2014 | Angelescu et al. | 436/180 |
| 2014/0238667 | A1 * | 8/2014 | Dumont et al. | 166/250.01 |
| 2014/0251604 | A1 * | 9/2014 | Jaramillo | 166/264 |
| 2014/0290941 | A1 * | 10/2014 | Villareal et al. | 166/250.07 |
| 2014/0345860 | A1 * | 11/2014 | Van Zuilekom et al. | 166/264 |
| 2014/0353479 | A1 * | 12/2014 | Edwards et al. | 250/255 |
| 2015/0159484 | A1 * | 6/2015 | Dumont et al. | E21B 49/086 |

OTHER PUBLICATIONS

International Search Report and Written Opinion issued in PCT/US2014/016072 on May 20, 2014, 16 pages.

* cited by examiner

DOWNHOLE FLUID ANALYSIS METHODS

CROSS-REFERENCE TO RELATED APPLICATIONS

This application claims the benefit of U.S. Provisional Application No. 61/770,097, entitled "Downhole Fluid Analysis Methods," filed Feb. 27, 2013, which is hereby incorporated herein by reference in its entirety.

BACKGROUND OF THE DISCLOSURE

Wellbores (also known as boreholes) are drilled to penetrate subterranean formations for hydrocarbon prospecting and production. During drilling operations, evaluations may be performed of the subterranean formation for various purposes, such as to locate hydrocarbon-producing formations and manage the production of hydrocarbons from these formations. To conduct formation evaluations, the drill string may include one or more drilling tools that test and/or sample the surrounding formation, or the drill string may be removed from the wellbore, and a wireline tool may be deployed into the wellbore to test and/or sample the formation. These drilling tools and wireline tools, as well as other wellbore tools conveyed on coiled tubing, drill pipe, casing or other conveyers, are also referred to herein as "downhole tools."

Formation evaluation may involve drawing fluid from the formation into a downhole tool for testing and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer. Within the downhole tool, the fluid may be directed to one or more fluid analyzers and sensors that may be employed to detect properties of the fluid while the downhole tool is stationary within the wellbore.

SUMMARY

The present disclosure relates to a downhole fluid analysis method that includes collecting fluid within a fluid analysis system of a downhole tool, withdrawing the downhole tool from a wellbore while the collected fluid is exposed to the wellbore pressure, and recording fluid analysis measurements and corresponding decreasing pressure measurements during withdrawal of the downhole tool.

The present disclosure also relates to a downhole fluid analysis method that includes receiving formation fluid through a probe of a downhole tool, collecting the formation fluid within a primary flowline disposed in a fluid analysis module of a downhole tool, exposing the primary flowline to an wellbore pressure, withdrawing the downhole tool from a wellbore while the collected formation fluid in the primary flowline is exposed to the wellbore pressure, and performing fluid analysis measurements and corresponding decreasing pressure measurements for the collected formation fluid during withdrawal of the downhole tool.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

It is to be understood that the present disclosure provides many different embodiments, or examples, for implementing different features of various embodiments. Specific examples of components and arrangements are described below to simplify the present disclosure. These are, of course, merely examples and are not intended to be limiting.

The present disclosure relates to methods for performing fluid analysis while a downhole tool is withdrawn from a wellbore to the surface. In certain embodiments, fluid may be collected within a fluid analysis system of the downhole tool and the collected fluid may be exposed to the annulus (e.g., wellbore) pressure while removing the downhole tool from the wellbore. Measurements for the collected fluid, such as optical density, gas oil ratio, fluid density, fluid viscosity, fluorescence, temperature, and pressure, among others, may be recorded continuously or at intervals as the downhole tool is brought to the surface. Corresponding measurements of the decreasing pressure also may be recorded as the tool is brought to the surface. The measurements may be employed to determine properties of the fluid, such as the saturation pressure and the asphaltene onset pressure, among others.

Figure 1:
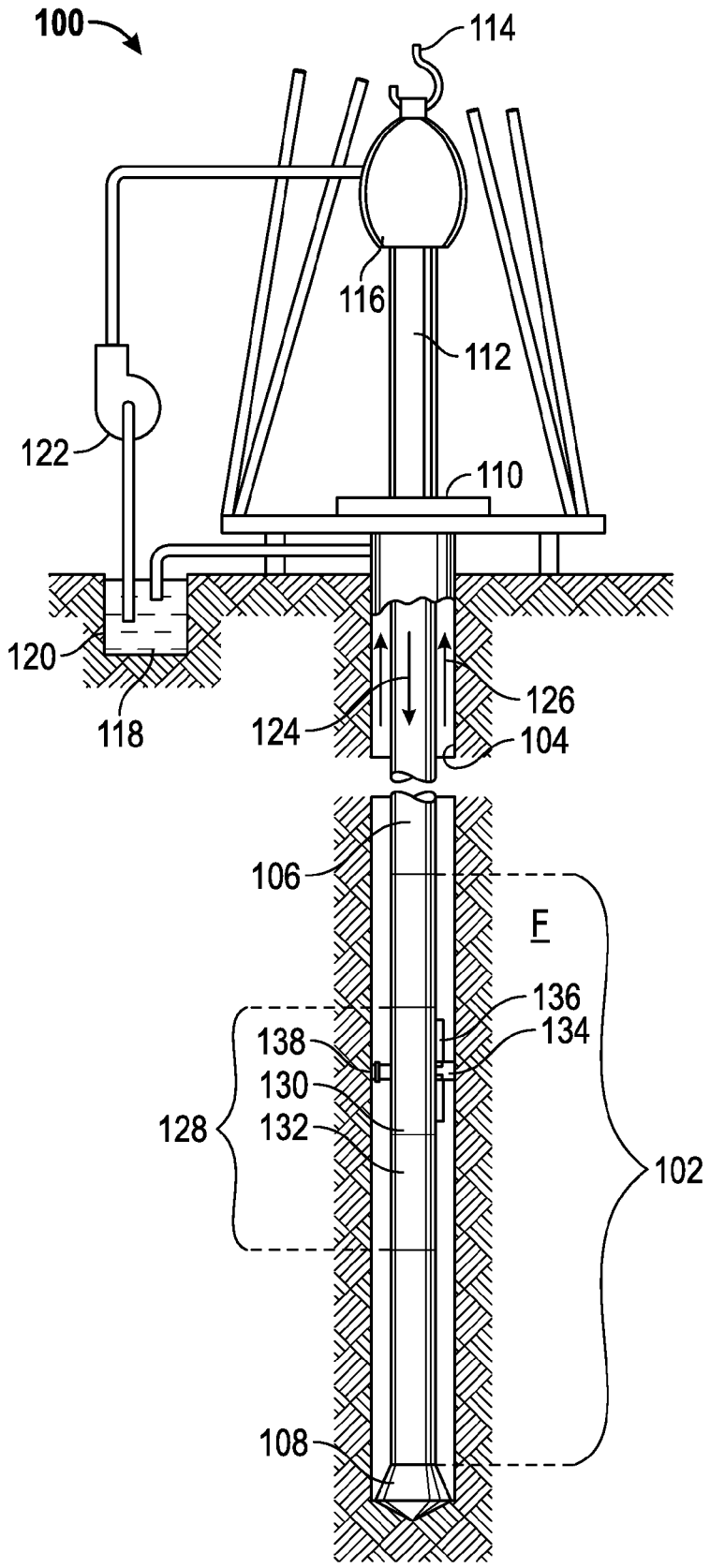
FIG. 1 is a schematic view of an embodiment of a wellsite system that may employ downhole fluid analysis methods, according to aspects of the present disclosure.
Figure 2:
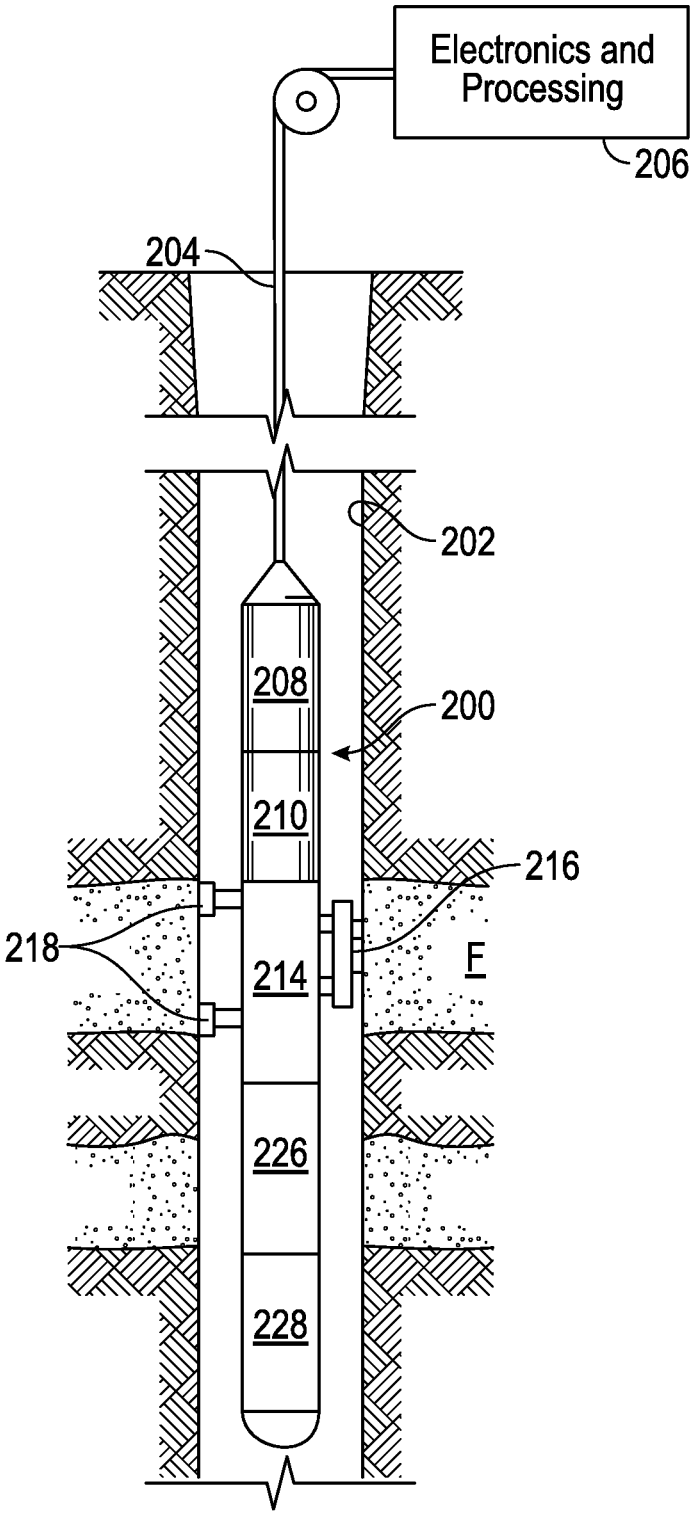
FIG. 2 is a schematic view of another embodiment of a wellsite system that may employ downhole fluid analysis methods, according to aspects of the present disclosure.

FIGS. 1 and 2 depict examples of wellsite systems that may employ the fluid analysis systems and techniques described herein. FIG. 1 depicts a rig 100 with a downhole tool 102 suspended therefrom and into a wellbore 104 via a drill string 106. The downhole tool 100 has a drill bit 108 at its lower end thereof that is used to advance the downhole tool into the formation and form the wellbore. The drillstring 106 is rotated by a rotary table 110, energized by means not shown, which engages a kelly 112 at the upper end of the drillstring 106. The drillstring 106 is suspended from a hook 114, attached to a traveling block (also not shown), through the kelly 112 and a rotary swivel 116 that permits rotation of the drillstring 106 relative to the hook 114. The rig 100 is depicted as a land-based platform and derrick assembly used to form the wellbore 104 by rotary drilling. However, in other embodiments, the rig 100 may be an offshore platform.

Drilling fluid or mud 118 is stored in a pit 120 formed at the well site. A pump 122 delivers the drilling fluid 118 to the interior of the drillstring 106 via a port in the swivel 116, inducing the drilling fluid to flow downwardly through the drillstring 106 as indicated by a directional arrow 124. The drilling fluid exits the drillstring 106 via ports in the drill bit 108, and then circulates upwardly through the region between the outside of the drillstring and the wall of the wellbore, called the annulus, as indicated by directional arrows 126. The drilling fluid lubricates the drill bit 108 and carries formation cuttings up to the surface as it is returned to the pit 120 for recirculation.

The downhole tool 102, sometimes referred to as a bottom hole assembly ("BHA"), may be positioned near the drill bit 108 and includes various components with capabilities, such as measuring, processing, and storing information, as well as communicating with the surface. A telemetry device (not shown) also may be provided for communicating with a surface unit (not shown).

The downhole tool 102 further includes a sampling while drilling ("SWD") system 128 including a fluid communication module 130 and a sampling module 132. The modules may be housed in a drill collar for performing various formation evaluation functions, such as pressure testing and sampling, among others. As shown in FIG. 1, the fluid communication module 130 is positioned adjacent the sampling module 132; however the position of the fluid communication module 130, as well as other modules, may vary in other embodiments. Additional devices, such as pumps, gauges, sensor, monitors or other devices usable in downhole sampling and/or testing also may be provided. The additional devices may be incorporated into modules 130 and 132 or disposed within separate modules included within the SWD system 128.

The fluid communication module 130 includes a probe 134, which may be positioned in a stabilizer blade or rib 136. The probe 134 includes one or more inlets for receiving formation fluid and one or more flowlines (not shown) extending into the downhole tool for passing fluids through the tool. In certain embodiments, the probe 134 may include a single inlet designed to direct formation fluid into a flowline within the downhole tool. Further, in other embodiments, the probe may include multiple inlets that may, for example, be used for focused sampling. In these embodiments, the probe may be connected to a sampling flow line, as well as to guard flow lines. The probe 134 may be movable between extended and retracted positions for selectively engaging a wall of the wellbore 104 and acquiring fluid samples from the formation F. One or more setting pistons 138 may be provided to assist in positioning the fluid communication device against the wellbore wall.

FIG. 2 depicts an example of a wireline downhole tool 200 that may employ the systems and techniques described herein. The downhole tool 200 is suspended in a wellbore 202 from the lower end of a multi-conductor cable 204 that is spooled on a winch (not shown) at the surface. The cable 204 is communicatively coupled to an electronics and processing system 206. The downhole tool 200 includes an elongated body 208 that includes a fluid communication module 214 that has a selectively extendable probe 216 and backup pistons 218 that are arranged on opposite sides of the elongated body 208. The extendable probe 216 is configured to selectively seal off or isolate selected portions of the wall of the wellbore 202 to fluidly couple to the adjacent formation F and/or to draw fluid samples from the formation F. The probe 216 may include a single inlet or multiple inlets designed for guarded or focused sampling. Additional modules (e.g., 210) that provide additional functionality such as fluid analysis, resistivity measurements, coring, or imaging, among others, also may also be included in the tool 200.

The formation fluid may be expelled through a port (not shown) or it may be sent to one or more fluid sampling modules 226 and 228. In the illustrated example, the electronics and processing system 206 and/or a downhole control system are configured to control the extendable probe assembly 216 and/or the drawing of a fluid sample from the formation F.

Figure 3:
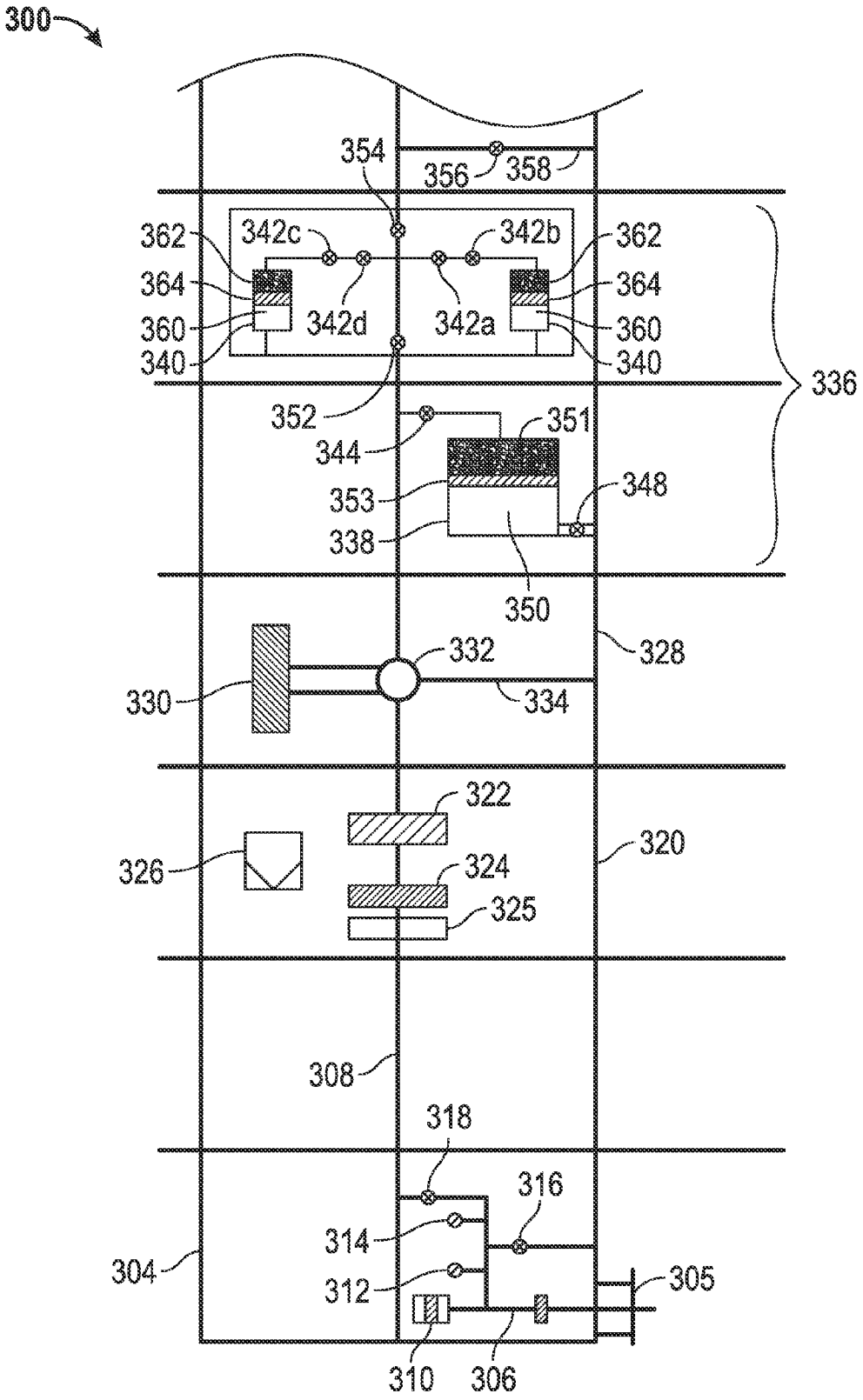
FIG. 3 is a schematic representation of an embodiment of a downhole tool that may employ downhole fluid analysis methods, according to aspects of the present disclosure.
Figure 4:
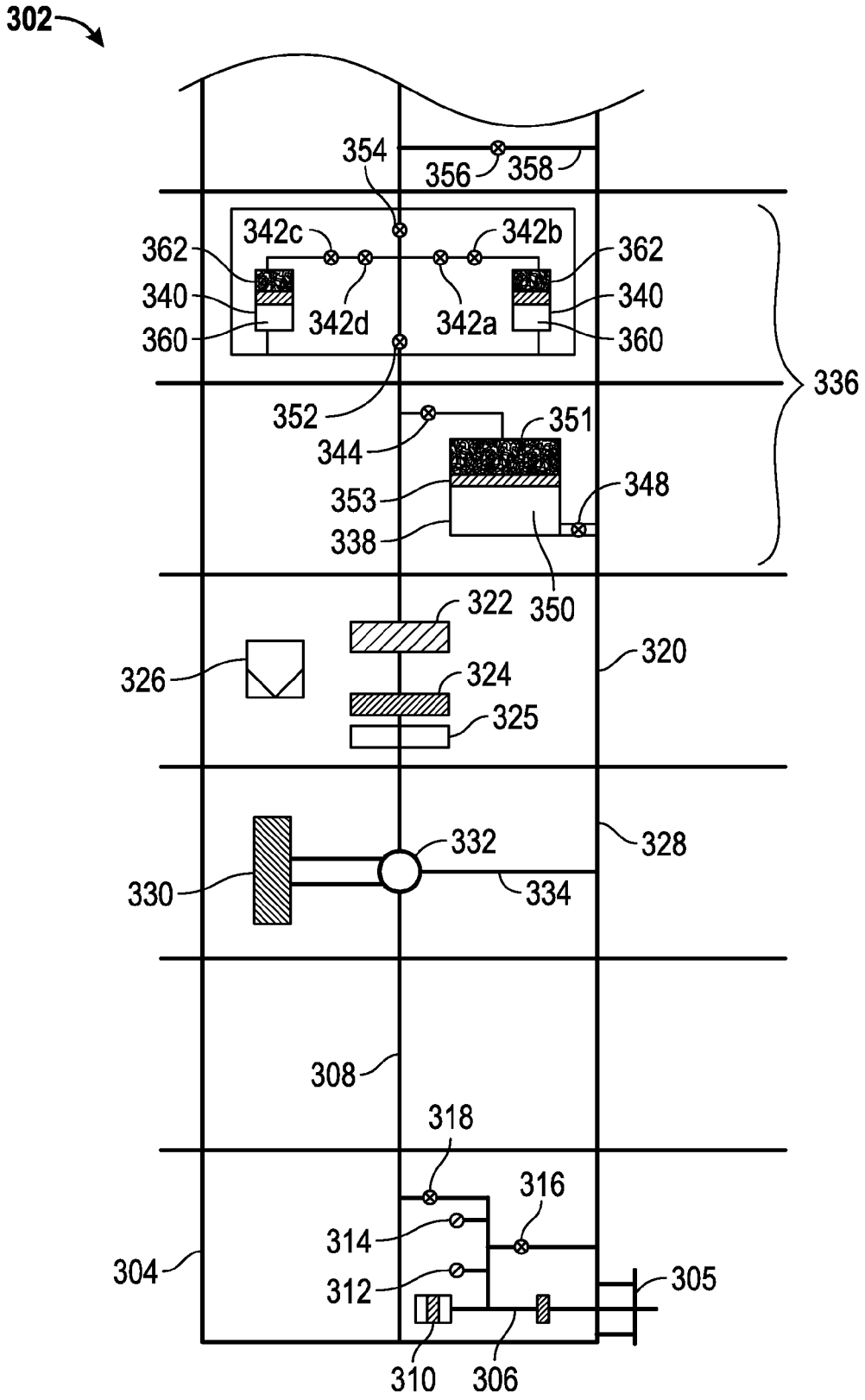
FIG. 4 is a schematic representation of another embodiment of a downhole tool that may employ downhole fluid analysis methods, according to aspects of the present disclosure.

FIGS. 3 and 4 are schematic diagrams of portions of downhole tools 300 and 302 that may employ the fluid analysis methods described herein. For example, the downhole tool 300 or 302 may be a drilling tool, such as the downhole tool 102 described above with respect to FIG. 1. Further, the downhole tool 300 or 302 may be a wireline tool, such as the downhole tool 200 described above with respect to FIG. 2. Further, in other embodiments, the downhole tool may be conveyed on wired drill pipe, a combination of wired drill pipe and wireline, or other suitable types of conveyance.

As shown in FIG. 3, the downhole tool 300 includes a fluid communication module 304 that has a probe 306 for directing formation fluid into the downhole tool 300. According, to certain embodiments, the fluid communication module 304 may be similar to the fluid communication modules 130 and 214, described above with respect to FIGS. 1 and 2, respectively. The fluid communication module 304 includes a probe flowline 306 that directs the fluid to a primary flowline 308 that extends through the downhole tool 300. The fluid communication module 304 also includes a pump 310 and pressure gauges 312 and 314 that may be employed to conduct formation pressure tests. An equalization valve 316 may be opened to expose the flowline 306 to the pressure in the wellbore, which in turn may equalize the pressure within the downhole tool 300. Further, an isolation valve 318 may be closed to isolate the formation fluid within the flowline 306, and may be opened to direct the formation fluid from the probe flowline 306 to the primary flowline 308.

The primary flowline 308 directs the formation fluid through the downhole tool to a fluid analysis module 320 that can be employed to provide in situ downhole fluid measurements. For example, the fluid analysis module 320 may include an optical spectrometer 322 and a gas analyzer 324 designed to measure properties such as, optical density, fluid density, fluid viscosity, fluid fluorescence, fluid composition, and the fluid gas oil ratio (GOR), among others. According to certain embodiments, the spectrometer 332 may include any suitable number of measurement channels for detecting different wavelengths, and may include a filter-array spectrometer or a grating spectrometer. For example, the spectrometer 332 may be a filter-array absorption spectrometer having ten measurement channels. In other embodiments, the spectrometer 104 may have sixteen channels or twenty channels, and may be provided as a filter-array spectrometer or a grating spectrometer, or a combination thereof (e.g., a dual spectrometer), by way of example. According to certain embodiments, the gas analyzer 324 may include one or more photodetector arrays that detect reflected light rays at certain angles of incidence. The gas analyzer 324 also may include a light source, such as a light emitting diode, a prism, such as a sapphire prism, and a polarizer, among other components. In certain embodiments, the gas analyzer 324 may include a gas detector and one or more fluorescence detectors designed to detect free gas bubbles and retrograde condensate liquid drop out.

One or more additional measurement devices 325, such as temperature sensors, pressure sensors, resistivity sensors, density sensors, viscosity sensors, chemical sensors (e.g., for measuring pH or $H_2S$ levels), and gas chromatographs, may be included within the fluid analysis module 320. In certain embodiments, the fluid analysis module may include a controller 326, such as a microprocessor or control circuitry, designed to calculate certain fluid properties based on the sensor measurements. Further, in certain embodiments, the controller 326 may govern sampling operations based on the fluid measurements or properties. Moreover, in other embodiments, the controller 326 may be disposed within another module of the downhole tool 300.

The downhole tool 300 also includes a pump out module 328 that has a pump 330 designed to provide motive force to direct the fluid through the downhole tool 300. According to certain embodiments, the pump 330 may be a hydraulic displacement unit that receives fluid into alternating pump chambers. A valve block 332 may direct the fluid into and out of the alternating pump chambers. The valve block 332 also may direct the fluid exiting the pump 330 through the remainder of the primary flowline (e.g., towards the sample module 336) or may divert the fluid to the wellbore through a dump flowline 334.

The downhole tool 300 also includes one or more sample modules 336 designed to store samples of the formation fluid within sample chambers 338 and 340. The sample module 336 includes valves 342A, 342B, 342C, and 342D that may be actuated to divert the formation fluid into the sample chambers 340. The sample module 336 also includes a valve 344 that may be actuated to divert the formation fluid into the sample chamber 338. The sample chamber 338 also may include a valve 348 that can be opened to expose a volume 350 of the sample chamber 338 to the annular pressure. In certain embodiments, the valve 348 may be opened to allow buffer fluid to exit the volume 350 to the wellbore, which may provide backpressure during filling of the volume 351. According to certain embodiments, the volume 351, which may store formation fluid, may be separated from the volume 350 by a floating piston 353.

The sample module 336 also includes valves 352 and 354 that can be opened to allow formation fluid through the primary flowline in the sample module 336 or closed to isolate the sample module 336 from the remainder of the primary flowline 308. The sample module 336 further includes a valve 356 that can be opened to allow fluid to exit the sample module 336 and flow into the wellbore through a flowline 358. For example, the valve 356 may be opened to allow buffer fluid from volumes 360 within the sample chambers 340 to exit the sample module 336, which in turn may provide back pressure during filling of the volumes 362 within the sample chambers 340. In this embodiment, the valve 354 may be closed so that the buffer fluid flows through the flowline 358 and the valve 356 to the wellbore, which may provide back pressure during filling of the volumes 362 with formation fluid. According to certain embodiments, the volumes 360 may be separated by the volumes 362 by floating pistons 364.

The valve arrangements described herein are provided by way of example, and are not intended to be limiting. For example, the valves described herein may include valves of various types and configurations, such as ball valves, gate valves, solenoid valves, check valves, seal valves, two-way valves, three-way valves, four-way valves, and combinations thereof, among others. Further, in other embodiments, different arrangements of valves may be employed. For example, the valves 342A and 342B may be replaced by a single valve, and the valves 342C and 342D may be replaced by a single valve. In another example, the valves 354 and 356 may be replaced by a three-way valve designed to divert flow through the downhole tool and to the wellbore.

FIG. 4 depicts another embodiment of a downhole tool 302. The downhole tool 302 is similar to the downhole tool 300, described above with respect to FIG. 3. However, the fluid analysis module 320 is disposed between the pump out module 328 and the sample module 336, rather than between the pump out module 328 and the probe module 304. Accordingly, in FIG. 4, the fluid analysis module 320 is downstream of the pump out module 328, while in FIG. 3, the fluid analysis module 320 is upstream of the pump out module 328, with respect to fluid entering the downhole tool through the probe module 304. The operation of the modules 304, 320, 328, and 336 of the downhole tool 302 may be generally similar to that described above with respect to the downhole tool 300.

Figure 5:
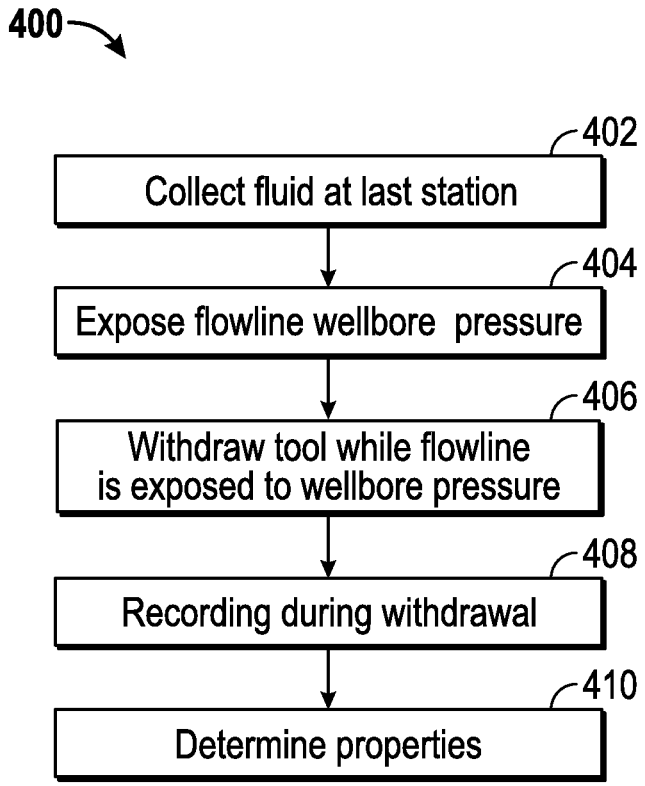
FIG. 5 is a flowchart depicting a fluid analysis method, according to aspects of the present disclosure.

FIG. 5 depicts a method 400 that may be performed to obtain fluid analysis measurements while a tool is returning to the surface. The method may begin by collecting (block 402) fluid at the last station designated for sampling within the wellbore. For example, at the final sampling location within the wellbore, formation fluid may be drawn into the downhole tool using the probe 305, as shown in FIGS. 3 and 4. The pump 330 may draw the formation fluid through the primary flowline 308 and into the fluid analysis module 320. At least a portion of the fluid may be retained within the fluid analysis module 320 for analysis as the tool is withdrawn from the wellbore and returned to the surface. As shown in FIGS. 3 and 4, the fluid may be retained in the fluid analysis module 320 within the primary flowline 308. However, in other embodiments, the fluid analysis module 320 may include one or more secondary flowlines or sample chambers design to retain the fluid.

The flowline containing the formation fluid is then exposed (block 404) to the wellbore pressure within the wellbore. According to certain embodiments, the wellbore pressure may be the hydrostatic pressure of the liquids contained within the wellbore, such as drilling fluids and/or wellbore fluids. As shown in FIGS. 3 and 4, the primary flowline 308 may be exposed to the wellbore pressure by opening one or more valves leading to the wellbore annulus. In other embodiments, secondary flowlines or sample chambers within the downhole fluid analysis module 320 may be exposed to the annular pressure. In the embodiment shown in FIG. 3, the probe 305 may be retracted towards the downhole tool 300, away from the formation, and the isolation valve 318 may be opened, or may be maintained in the open state, to expose the primary flowline 308 to the wellbore pressure through the probe flowline 306. In certain embodiments, the equalization valve 316 also may be opened. In another example, as shown in FIG. 3, the isolation valve 318 may be closed and valves within the valve block 332 may be configured to expose the primary flowline 308 to the wellbore pressure through the dump flowline 334. According to certain embodiments, a controller may ensure that the flowline is exposed to the annular pressure before withdrawing the tool to the surface. For example, the surface controller 206 or downhole controller 326 may transmit control signals to retract the probe 305 and open the isolation valve 318, or may transmit control signals to open one or more valves within the valve block 332. If one or more of the valves are already open, the controller 206 or 236 may maintain the valves in the open position.

In the embodiment shown in FIG. 4, the valves 352, 354, and 356 may be opened to expose the primary flowing 308 to the wellbore pressure through the flowline 358. In another example, as shown in FIG. 4, the valves 352, 354, and 356 may be closed, and valves within the valve block 332 may be configured to expose the primary flowline 308 to the wellbore pressure through the dump flowline 334. According to certain embodiments, a controller may ensure that the flowline is exposed to the annular pressure before withdrawing the tool to the surface. For example, the surface controller 206 or downhole controller 326 may transmit control signals to open the valves 352, 354, and 356, or may transmit control signals to open valves within the valve block 332. If one or more of the valves are already open, the controller 206 or 236 may maintain the valves in the open state.

After the flowline is exposed to the wellbore pressure, the tool may be withdrawn (block 406) to the surface. For example, the tool may be drawn to the surface by pulling the wireline 204 (FIG. 2) or the drillstring 106 (FIG. 1) to the surface. During withdrawal of the tool, the fluid analysis module may be employed to record (block 408) fluid analysis measurements for the fluid collected within the fluid analysis module 320. For example, the fluid analysis measurements may be recorded continuously, or at set intervals, as the downhole tool is brought to the surface, which also results in a decrease in pressure. Further, because the collected fluid is exposed to the wellbore pressure during the withdrawal of the downhole tool, the pressure of the collected fluid may generally correspond to the wellbore pressure. Accordingly, the fluid analysis measurements may represent a log of how the fluid properties change based on decreasing pressure. Further, a depth log of the tool may be recorded during withdrawal of the tool.

In certain embodiments, the fluid analysis measurements may include one or more measurements such as optical density, fluorescence, pH, resistivity, fluid density, fluid viscosity, fluid GOR, and fluid composition, among others, that may be recorded as the downhole tool is brought to the surface. Further, the pressure and temperature of the fluid collected within the downhole fluid analysis module, as well as the tool depth within the wellbore, may be recorded. The pressure and temperature may be recorded using pressure and temperature sensors disposed in the fluid analysis module, the probe module, or in other portions of the downhole tool in fluid communication with fluid at the wellbore pressure. For example, in the embodiment shown in FIG. 3, the sensors 312 and 314 and/or the measurement devices 325 may be employed to measure the pressure. In certain embodiments, a surface controller or downhole controller may be used to record the measurements made as the tool is brought to the surface.

The recorded fluid analysis measurements may then be employed (block 410) to determine properties of the formation fluid. For example, the recorded fluid analysis measurements may be used to determine the saturation pressure (e.g., the bubble point for an oil or the dew point for a gas) and the asphaltene onset pressure, among others. In another example, the recorded fluid analysis measurements may be used to establish a relationship for optical density, composition, GOR, fluid density, or fluid viscosity based on pressure and temperature change.

Figure 6:
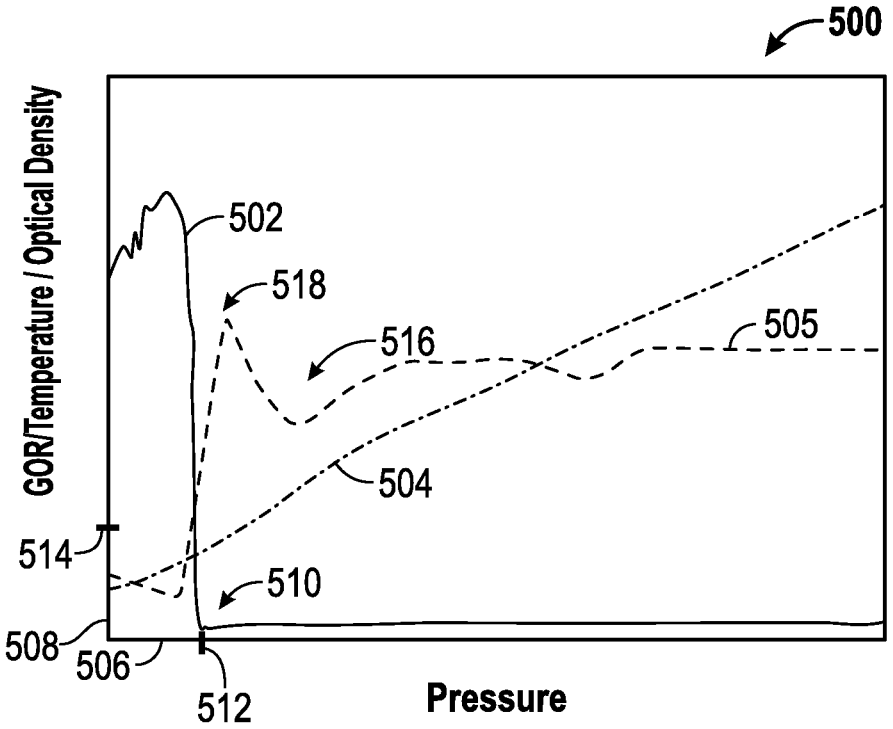
FIG. 6 is a plot depicting an embodiment of fluid analysis measurements obtained according to aspects of the present disclosure.
Figure 7:
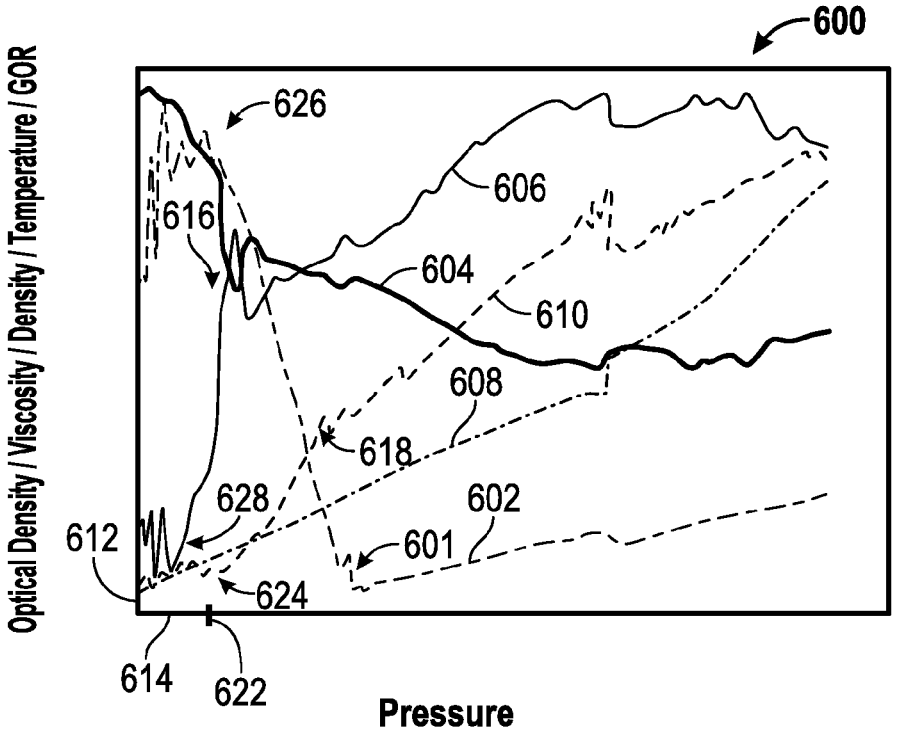
FIG. 7 is a plot depicting another embodiment of fluid analysis measurements obtained according to aspects of the present disclosure.
Figure 8:
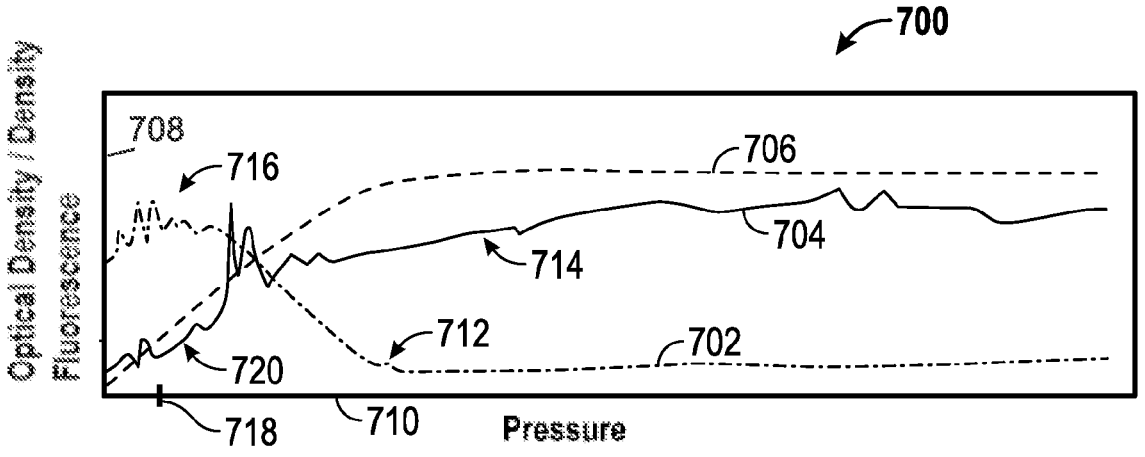
FIG. 8 is a plot also depicting another embodiment of fluid analysis measurement obtained according to aspects of the present disclosure.

FIGS. 6, 7, and 8 are plots depicting examples of properties that can be determined using the recorded fluid analysis measurements. FIG. 6 is a plot 500 depicting how the GOR 502, temperature 504, and optical density 505 of the collected fluid, each shown on the y-axis 508, change with respect to decreasing pressure, represented by the x-axis 506 with pressure decreasing right to left along the axis, as the tool is brought to the surface. The GOR 502 changes markedly at a point 510 (e.g., increases sharply), and the corresponding pressure 512 may represent the saturation pressure of the collected fluid, which may represent the bubble point for an oil or the dew point for a gas. Further, the corresponding temperature 514 may represent the saturation temperature of the collected fluid. Accordingly, the saturation pressure and temperature of the collected fluid may be determined by measurements of the GOR 502 made while the tool is withdrawn to the surface and exposed to the decreasing wellbore pressure. The optical density 505 also may be used to determine the saturation pressure of the collected fluid. For example, as shown in FIG. 6, the optical density 505 may increase at pressure slightly greater than the saturation pressure 512 as shown at point 516, and the optical density 505 may decrease at a pressure slightly lower than the saturation pressure 512 as shown at point 518.

FIG. 7 is a plot 600 depicting how the optical density 602, fluid viscosity 604, fluid density 606, temperature 608, and the GOR 610, each shown on the y-axis 612, change with respect to decreasing pressure, represented by the x-axis 614 with pressure decreasing right to left along the axis, as the tool is brought to the surface. The optical density 602 begins to markedly increase at a point 601, which signals the start of the asphaltene onset pressure (AOP) where asphaltenes begin to precipitate out of solution. As the asphaltenes precipitate out of solution, the GOR and density more sharply decrease, shown at points 618 and 616, respectively. The end of the sharp increase in optical density and the end of the sharp decrease in the GOR, shown respectively at points 626 and 624, may be used to approximate the asphaltene onset pressure, shown at point 622 on the x-axis 614. Further, the end of the sharp decrease in fluid density, shown generally at point 628, also may be used to approximate the asphaltene onset pressure. Accordingly, the asphaltene onset pressure may be determined by measurement of the GOR and optical density, as well as the fluid density, made while the tool is returning to the surface, which allows the collected fluid to be exposed to the decreasing wellbore pressure.

FIG. 8 is a plot 700 depicting how the optical density 702, fluid density 704, and fluorescence 706, each shown on the y-axis 708, change with respect to decreasing pressure, represented by the x-axis 710 with pressure decreasing right to left along the axis, as the tool is brought to the surface. The optical density begins to markedly increase at a point 712, which signals the start of the asphaltene onset pressure (AOP) where asphaltenes begin to precipitate out of solution. As the asphaltenes precipitate out of solution, the fluid density more sharply decreases, shown at point 714. Further, the fluorescence 706 also markedly decreases, shown at point 716. The end of the sharp increase in optical density, shown at point 716, may be used to approximate the asphaltene onset pressure, shown at point 718 on the x-axis 710. Further, the end of the sharp decrease in fluid density, shown generally at point 720, also may be used to approximate the asphaltene onset pressure.

As illustrated by comparing FIG. 6 to FIGS. 7 and 8, the optical density may increase and then decrease at pressures surrounding both the asphaltene onset pressure (FIG. 7, points 601 and 626, and FIG. 8, points 712 and 716) and the saturation pressure (FIG. 6, points 516 and 518). Further, although the GOR is shown as markedly increasing in FIG. 6 at point 510 adjacent the saturation pressure 512, in other embodiments, the GOR may markedly decrease at pressures adjacent the saturation pressure 512. In other words, while a marked change in the GOR may indicate the saturation pressure, the change in the GOR may be an increase or a decrease depending on the behavior of the collected fluid. For example, in certain embodiments, where the saturation pressure represents the dew point, the GOR may decrease at pressures adjacent the saturation pressure.

The fluorescence, however, may respond differently at the saturation pressure and the asphaltene onset pressure. As described above with respect to FIG. 8, the fluorescence may markedly decrease beginning at s pressure, shown at point 716 on FIG. 8, slightly higher than the asphaltene onset pressure. According to certain embodiments, the decrease in fluorescence may be caused by asphaltenes beginning to precipitate and collect on an optical window or cell within the optical spectrometer. On the other hand, the fluorescence may markedly increase beginning at a pressure slightly higher than the saturation pressure. According to certain embodiments, the increase in fluorescence may be caused by the collection of retrograde dew on an optical window or cell within the optical spectrometer. Because fluorescence may decrease at pressures adjacent the asphaltene onset pressure and increase at pressures adjacent the saturation pressure, the fluorescence may be used to determine whether the changes in optical density and GOR indicate an asphaltene onset pressure or a saturation pressure.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A downhole fluid analysis method comprising:

collecting fluid within a fluid analysis system of a downhole tool;

withdrawing the downhole tool from a wellbore while the collected fluid is exposed to a wellbore pressure;

exposing the collected fluid to the wellbore pressure prior to withdrawing the downhole tool from the wellbore, wherein exposing the collected fluid to the wellbore pressure comprises opening an isolation valve disposed in a probe flowline of the downhole tool; and recording fluid analysis measurements and corresponding decreasing pressure measurements during withdrawal of the downhole tool.

2. The method of claim 1, wherein collecting fluid comprising extracting fluid from a formation through an extendable probe of the downhole tool.

3. The method of claim 1, wherein collecting fluid comprises disposing the fluid within a portion of a primary flowline of the downhole tool extending through the downhole fluid analysis system.

4. The method of claim 1, wherein recording fluid analysis measurement comprises measuring optical density of the collected fluid with an optical spectrometer.

5. The method of claim 1, wherein recording fluid analysis measurements comprises measuring a gas oil ratio of the collected fluid with a gas analyzer.

6. The method of claim 1, wherein recording fluid analysis measurements comprises measuring optical density, a gas oil ratio, and fluorescence.

7. A downhole fluid analysis method comprising:

receiving formation fluid through a probe of a downhole tool, wherein receiving formation fluid comprises directing the formation fluid through a probe flowline of the downhole tool;

collecting the formation fluid within a primary flowline disposed in a fluid analysis module of a downhole tool;

exposing the primary flowline to a wellbore pressure, wherein exposing the primary flowline to the wellbore pressure comprises closing an isolation valve disposed in the probe flowline and opening a valve disposed in a dump flowline of the downhole tool;

withdrawing the downhole tool from a wellbore while the collected formation fluid in the primary flowline is exposed to the wellbore pressure; and performing fluid analysis measurements and corresponding decreasing pressure measurements for the collected formation fluid during withdrawal of the downhole tool.

8. The method of claim 7, wherein collecting the formation fluid comprising pumping the formation fluid from the probe to the fluid analysis module with a pump disposed in the downhole tool downstream of the fluid analysis module with respect to the probe.

9. The method of claim 7, wherein collecting the formation fluid comprises directing the formation fluid through a pump and into the fluid analysis module, wherein the fluid analysis module is disposed in the downhole tool between the pump and a sample module.

10. The method of claim 7, comprising determining properties of the formation fluid based on the fluid analysis measurements.

11. The method of claim 10, wherein performing fluid analysis measurements comprises measuring a gas oil ratio of the formation fluid, and wherein determining properties comprises determining a saturation pressure based on a change in the gas oil ratio.

12. The method of claim 10, wherein performing fluid analysis measurements comprises measuring an optical density and a fluorescence of the formation fluid, and wherein determining properties comprises determining an asphaltene onset pressure based on an increase in the optical density and a decrease in the fluorescence.

13. The method of claim 7 wherein performing fluid analysis measurement comprises continuously performing fluid analysis measurements and generating a corresponding depth log during withdrawal of the downhole tool.

14. A downhole fluid analysis method comprising:

receiving formation fluid through a probe of a downhole tool, wherein receiving formation fluid comprises directing the formation fluid through a probe flowline of the downhole tool;

collecting the formation fluid within a primary flowline disposed in a fluid analysis module of a downhole tool;

exposing the primary flowline to a wellbore pressure, wherein exposing the primary flowline to the wellbore pressure comprises opening an equalization valve of the downhole tool disposed in an equalization line coupled to the probe flowline;

withdrawing the downhole tool from a wellbore while the collected formation fluid in the primary flowline is exposed to the wellbore pressure; and performing fluid analysis measurements and corresponding decreasing pressure measurements for the collected formation fluid during withdrawal of the downhole tool.

* * * * *